US010757981B2

(12) United States Patent
Blibech

(10) Patent No.: US 10,757,981 B2
(45) Date of Patent: Sep. 1, 2020

(54) ELASTIC KNITTED MALE UNDERGARMENT

(71) Applicant: Hanes Operations Europe SAS, Rueil-Malmaison (FR)

(72) Inventor: Ragheb Blibech, Paris (FR)

(73) Assignee: Hanes Operations Europe SAS, Rueil-Malmaison (FR)

( * ) Notice: Subject to any disclaimer, the term of this patent is extended or adjusted under 35 U.S.C. 154(b) by 126 days.

(21) Appl. No.: 16/119,928

(22) Filed: Aug. 31, 2018

(65) Prior Publication Data

US 2019/0059452 A1 Feb. 28, 2019

Related U.S. Application Data

(63) Continuation of application No. 14/392,300, filed as application No. PCT/FR2014/051592 on Jun. 25, 2014, now Pat. No. 10,165,801.

(30) Foreign Application Priority Data

Jun. 26, 2013 (FR) ..... 13 56135

(51) Int. Cl.
*A41B 9/02* (2006.01)

(52) U.S. Cl.
CPC ..... *A41B 9/023* (2013.01); *A41B 9/02* (2013.01); *A41B 2300/22* (2013.01); *A41B 2500/10* (2013.01)

(58) Field of Classification Search
CPC ..... A41B 9/02; A41B 9/023; A41B 9/001
(Continued)

(56) References Cited

U.S. PATENT DOCUMENTS 4,644,945 A 2/1987 Thorner
4,701,964 A 10/1987 Prunesti et al.
(Continued)

FOREIGN PATENT DOCUMENTS

CN 2332195 8/1999
CN 202019741 11/2011
(Continued)

OTHER PUBLICATIONS

Australian Government IP Australia, Patent Examination Report No. 1, Australian Application No. 2014300872, dated Jun. 17, 2016, 2 pages.

(Continued)

*Primary Examiner* — Timothy K Trieu
(74) *Attorney, Agent, or Firm* — Fish & Richardson P.C.

(57) ABSTRACT

This item of male underwear, in the form of boxer shorts or underpants, has, at the front, a moulded central portion (16) and elongate reinforcement elements (20, 20', 21, 21', 22, 22') made, for example, from silicone, provided in three areas (A, B, C) of the front face (11), i.e. —A support area (A) located at the bottom of the central portion (16), the elongate elements (20, 20') being shaped substantially like a cradle in this area, —A control area (B) located at the top of the central portion (16), the elongate elements (21, 21') being shaped substantially like an inverted cradle in this area, —A reinforcement area (C) located to each side of the central portion, the elongate elements (22, 22') having, in this area, an inclined direction linking the edges (19) of the central portion (16) to the top of the front face (11) in such a way as to pull the support area (A) upwards and towards the sides.

20 Claims, 1 Drawing Sheet

(58) Field of Classification Search
USPC ..... 2/404
See application file for complete search history.

(56) References Cited

U.S. PATENT DOCUMENTS

| | | | | |
|---|---|---|---|---|
| 5,606,748 | A | 3/1997 | Fujiwara | |
| 7,087,032 | B1 | 8/2006 | Ikeda | |
| 7,260,961 | B1 | 8/2007 | Kennedy | |
| 7,765,618 | B2 | 8/2010 | Egglesfield | |
| 2007/0079427 | A1* | 4/2007 | Herbert | D04B 1/243 2/403 |
| 2008/0178369 | A1 | 7/2008 | Kitsch et al. | |
| 2009/0047481 | A1 | 2/2009 | Welsch | |
| 2012/0204325 | A1 | 8/2012 | Todd et al. | |
| 2014/0080381 | A1* | 3/2014 | Jones | A41D 7/00 450/95 |
| 2014/0359920 | A1 | 12/2014 | Sabin | |
| 2015/0296894 | A1* | 10/2015 | Turlan-Van Der Hoeven | A41B 9/04 450/97 |
| 2016/0150829 | A1 | 6/2016 | Todd | |

FOREIGN PATENT DOCUMENTS

| | | | |
|---|---|---|---|
| CN | 102548433 | | 4/2012 |
| DE | 129707233 | U1 | 6/1997 |
| EP | 0654226 | A1 | 5/1995 |
| FR | 2621457 | A1 | 4/1989 |
| GB | 2474558 | A | 4/2011 |
| JP | H06-025304 | U | 4/1994 |
| JP | 2006089911 | A | 4/2006 |
| KR | 2020090011458 | U | 11/2011 |
| WO | WO02/24007 | A1 | 3/2002 |
| WO | WO2010050539 | A1 | 5/2010 |

OTHER PUBLICATIONS

Canadian Intellectual Property Office, Notice of Requisition by the Examiner, Canadian Application No. CA 2,915,994, dated Dec. 9, 2016, 21 pages.

Japanese Patent Office, Notice of Reason for Rejection, Japanese Patent Application No. 2016-522703, dated Mar. 9, 2017, 6 pages.

Korean Intellectual Property Office, Office Action, dated Jan. 13, 2017, 13 pages.

PCT International Search Report and Written Opinion of the International Searching Authority, PCT/FR2014/051592, dated Aug. 27, 2014, 13 pages.

The State Intellectual Property Office of the People's Republic of China, Chinese Application No. 2014800368365, dated Jun. 22, 2016, 9 pages.

* cited by examiner

ELASTIC KNITTED MALE UNDERGARMENT

CROSS-REFERENCE TO RELATED APPLICATIONS

This application is a continuation application of and claims the benefit of priority to U.S. application Ser. No. 14/392,300, filed on Dec. 23, 2015, which is a U.S. National Stage of International Application No. PCT/FR/2014/051592, filed on Jun. 25, 2014, which claims priority to French Patent Application No. 1356135, filed on Jun. 26, 2013, the contents of which are hereby incorporated by reference.

TECHNICAL FIELD

The present disclosure concerns an elastic knit article of lingerie, consisting of a men's under-garment for the lower part of the body, particularly of the brief, boxer short, or trunk type.

BACKGROUND

Such an under-garment exhibits a rear side and a front side, which can be achieved in the form of the same, single, knit tube or can be obtained by assembling front and rear panels.

For the comfort of the wearer's genitals, the front side includes a central part exhibiting a curve towards the exterior, advantageously obtained by molding, forming a pouch. This curve provides considerable comfort to the wearer by offering more room for the genitals. Even so, depending on the particular anatomy of the wearer, the space formed by the curve is more or less filled, and an unaesthetic appearance of the under-garment can result when worn. If a thicker textile material is chosen in which to execute this curved part, such as a 3D spacer knit, the visual appearance of the pouch is improved to some extent, at the expense, however, of a natural look, and the degree of opacity is increased. But if the material is thick and heavy, it is detrimental to comfort and yields a protruding curve when the article is laid flat. Briefs are known from patent document FR 2621457, which include elongated, elastic reinforcing elements provided on the front side of the briefs, and particularly over the central part, to reinforce support of the genitals, but these elongated elements are in the form of bands fastened only at their ends onto the front side, and they lead to unsightly deformations. Briefs are known from patent document GB 2474558 which complies with the preamble to Claim 1 hereto attached.

SUMMARY

The aim of the disclosure is to propose a construction alternative for men's under-garments which does not exhibit these drawbacks but which, on the contrary, allows an under-garment to be obtained which is both comfortable and aesthetically pleasing.

The disclosure achieves its goal thanks to an under-garment exhibiting the characteristics of Claim 1 hereto attached, that is, a men's under-garment for the lower part of the body exhibiting a pant part with a rear side and a front side, which includes an upper belt part and a lower crotch part, the front side including in its middle a vertical, central part intended to accommodate the genitals of the wearer and exhibited in the form of a piece including a relatively wide, lower portion for the crotch part and a relatively narrow, upper portion for the belt part, as well as edges, elongated elastic reinforcing elements being provided on the front side and particularly over the central part to reinforce the support of the genitals, characterized in that the elongated elements are provided in three zones of the front side, that is:

- a support zone located at the bottom of the central part, the elongated elements having a roughly cradle-like shape in this zone,
- a control zone located at the top of the central part, the elongated elements having a shape roughly like an inverted cradle in this zone,
- a reinforcement zone located on either side of the central part, the elongated elements in this zone having a slanted direction and binding the edges of the central part at the upper belt part of the front side so as to draw the support zone toward the top and the sides.

The presence of reinforcing elements in these three zones and disposed in the manner described ensures good support for the genitals while still giving the pant a tight appearance, that clings to the body.

The disclosure also advantageously exhibits the following characteristics, independently or in combination:

- The upper, belt part is more elastic than the rest of the front side. The sought elasticity can result from a different material, making up a belt added on or knit with a different thread or stitch; or the elasticity sought for the upper, belt portion can come from reinforcements disposed on this part, for example at the same time as the elongated reinforcing elements of the disclosure.
- The central part forming a pouch is molded to give it an outward curve.
- The elongated elements in each zone form at least one network of parallel lines, advantageously two symmetrical networks which cross one another in the two first zones. This crossing increases the reinforcing action at places where it occurs and gives said action a bidirectional character.
- Part of the elongated elements in the reinforcement zone extend into the support zone without changing direction.
- Part of the elongated elements in the reinforcement zone extend into the control zone, but changing direction.
- According to the disclosure, the reinforcing elements are inserted into, or fastened roughly continuously to, the front side and not just fastened at their ends. Although it is conceivable to form the elongated reinforcing elements by knitting, by taking advantage during the knitting of the nature of the threads used and the choice of stitch, it is particularly advantageous if the elongated elements are elements added on, which allows the knit base of the front side to be achieved with no particular difficulty and allows for adding the elongated elements. The reinforcing elements in particular can be added on by embroidering, by affixing tape or a heat-sealed adhesive material, or by laying down a polymer, whereby the manner of adding them on fastens the element in a roughly continuous manner to the front side.
- If the elongated elements are added on by embroidering, elastic threads can be embroidered onto the material in the three said zones, and the material thus reinforced is then molded.
- If the elongated elements added on are in the form of elastic, thermoformed bands having an elasticity higher than or equal to that of the principal material, the bands and principal material can be heat-sealed and then molded. These two operations can also be performed at the same time. This depends on the ease of band placement, the size of the heat press, and the pressure and thermal parameters. It is economically more advantageous to do this at the same time. Gluing at points can be used, with the points being sufficiently numerous and close together to assimilate the glue in a continuous sealing process.

The elongated elements added on can be in the form of a structured material with elasticity higher than or equal to that of the principal material and which can be glued onto it in a single heat-sealing and molding operation or in successive operations.

According to a preferred embodiment, the elongated elements added on are relatively thin lines or cords of elastic polymer or elastomer, and particularly of silicone rubber, which can be applied flat onto the material of the front side, and particularly onto that of the central part, which can be reticulated and molded after reticulation, in order to shape the pouch. Here, it is successively reticulated and then molded, because the duration and temperature of reticulation for silicone rubber are greater than the duration of the molding. The reticulation of the silicone and the molding can be performed in a single operation if the duration and temperature of the silicone reticulation and those of the molding are similar. The polymer lines form one or several networks of elastic polymer or elastomer defining, by the elongated shape of their roughly parallel lines in each network, a preferred direction of elastic reinforcement. The polymer can be laid down so as to form more or less wide lines, which provide a certain elastic compression in the said preferred direction. The polymer is not laid down uniformly over the entire surface of the garment, but only on a relatively limited part thereof. The side where the polymer is applied is preferably the outside, in order to create a stylish effect and to avoid the direct contact of the polymer with the skin of the wearer.

The base knit of the pant is achieved in jersey knit based on polyamide, cotton, or polyester, and of spandex (preferably less than 30% by weight of spandex relative to the total weight of the knit) or of a mixture of these components. It advantageously exhibits a 15-newton elongation (according to the BS 4952 standard) equal to or greater than 110%, at least in length.

The density of the base knit is advantageously on the order of 150 to 200 g/m$^2$ (ISO 3801 standard). In a particular typical case, a 95% cotton/5% spandex material is used, 170 g/m$^2$.

The silicone is advantageously a bicomponent HTV silicone. It's Shore A hardness is advantageously between 10 and 40. In a particular typical case, a silicone with a Shore hardness of 30 is used.

BRIEF DESCRIPTION OF THE DRAWINGS

Other characteristics and advantages of the disclosure will result from the following description of two particular embodiments. Reference will be made to the drawings attached.

DETAILED DESCRIPTION

Figure 1:
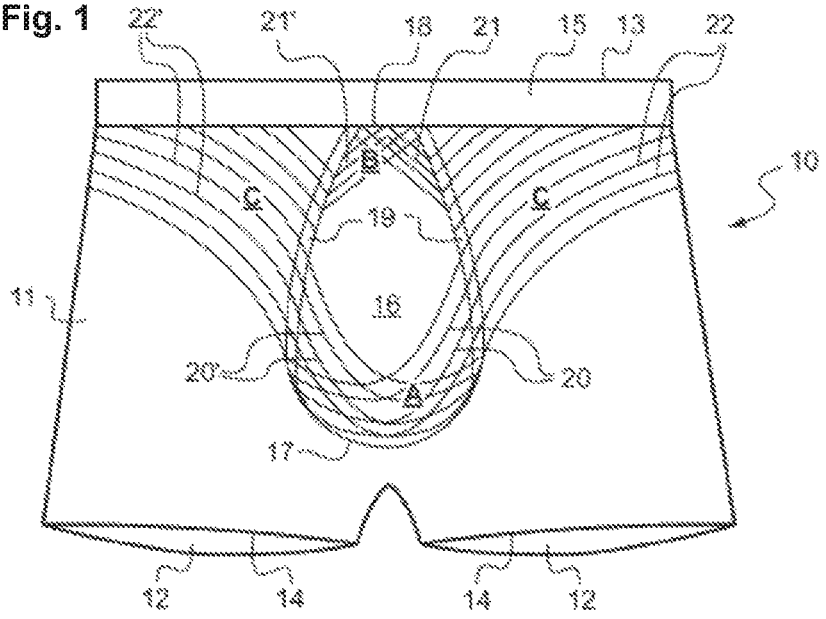
FIGS. 1 and 2 are frontal views of trunks and of briefs executed according to the disclosure.
Figure 2:
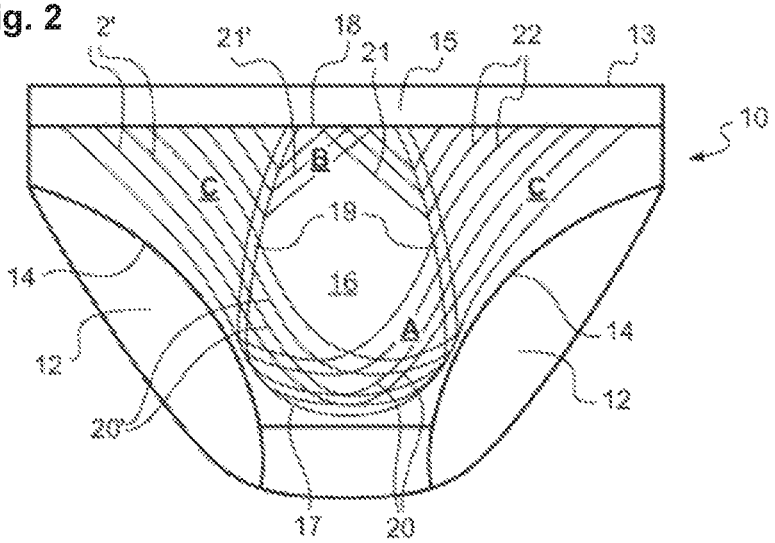

FIGS. 1 and 2 show the front 11 and only partially the rear 12 of a trunk or brief 10 according to the disclosure, which includes, in a conventional manner at the upper part, an upper opening 13 for passage of the torso and at the lower crotch part, two lower openings 14 for passage of thigh or leg. The pant 1 can be knit on a circular loom and can be seamless (except possibly at the crotch). Alternatively, it can be made up of two panels, front and rear, knit on a straight loom and sewn together. The knit is elastic. The upper opening 13 includes an upper, elastic belt part 15, which can itself be obtained in any known manner, for example entirely by knitting or by sewing, gluing, or heat-sealing one elastic add-on piece, textile or not, or by applying an elastic polymer (particularly at the same time as the elongated reinforcing elements of the disclosure).

The pant 1 is knit in a jersey knit, for example. The proportion of spandex in the knit is about 5%, the density of the knit is 170 g/m$^2$, and its elongation is 130% in the direction corresponding to the width of the pant.

The front 11 of the pant includes, roughly vertical to the middle of the front side, a central part 16 intended to be molded and forming a closed pouch for the genitals. The central part 16 is roughly in the shape of a curvilinear trapezoid with a wide, curved base 17 toward the bottom of the front 11, in the proximity of the crotch, and relatively wide in order to be able to envelope the genitals at the testicles, a small upper base 18 at the bottom of the belt 15, relatively narrow, these bases 17 and 18 being bound together by the symmetrical oblique sides 19. The oblique sides 19 can be achieved by seams if the central part 16 is executed in a material other than that of the rest of the front part 11 or if the central part 16 contains a lining (for reasons of hygiene). Otherwise, they can be achieved by means of false seams or not even executed. The central part 16 is the part which receives an outward curve by molding under heat and pressure. It thus forms a convex zone, whereas the remainder of the front 11 is flat. By way of example illustrating the molding, in a typical example, a mold was used exhibiting the following characteristics: depth 4.5 cm; diameter 85 mm; heating time 40 sec, temperature of the mold (having a male and a female part) about 190° C.

The front 11 of the pant 1 is covered in three zones A, B, C by a network of elongated elements in the form of two sets of roughly parallel lines of silicone rubber.

In the support zone A defined by the bottom of the central part 16, the network of lines is formed of two sets of parallel lines 20 and 20', which cross each other towards the bottom. The two sets of lines 20, 20' form a cradle-like network, that is to say, a little like a hanging chain, which allows the genitals to be suitably supported. These lines 20, 20' are 4 or 5 in number, for example, and are made up of quite a steep part which goes down edges 19, its slope decreasing or disappearing or even being reversed at the end of the line before meeting the bottom of opposite edge 19 or base 17.

Control zone B is formed in the top portion of central part 16. A network of lines is formed of two sets of parallel lines 21 and 21', which cross one another towards the top. The two sets of lines 21, 21' form an inverted-cradle-like network. Numbering 4 or 5, said lines constitute relatively short, straight lines, which descend from the small base 18 below belt 15 to meet the top of edges 19. Their action is to adjust and pull the material toward the top of the pouch, which allows a hollow or empty effect to be countered, which would otherwise be pronounced at the pouch.

Finally, in the two lateral reinforcement zones C, a network of parallel lines 22, 22' allows the sides 19 of the pouch to be "suspended", as it were, at the base of the belt 13 and at the seams present on the sides. These lines 22, 22' pull zone A toward the top, which improves the support of the genitals, and toward the sides, which renders the curve more smooth and in parallel allows the under-garment to cling to the body at the groin. Comfort and the sense of support are thereby improved. Comparing the reinforcing structure in zones C of FIG. 1 and FIG. 2, it is noted that a more extensive zone C is provided for the trunks than for the briefs, insofar as the latter, which have no legs, naturally hug the body shape of the wearer better.

In the two examples represented in FIGS. 1 and 2, it will be observed that part of lines 22, 22' are extended by lines 20, 20' and that another part of lines 22, 22' end at sides 19 at the same place as lines 21, 21'. Aside from the aesthetic advantages of such an arrangement, more effective support of zone A by the reinforcements of zone C is also noted, as well as implementation possibly being facilitated by the continuity of the lines.

Lines 20, 20', 21, 21', 22, 22' can have different widths or can be entirely identical in width. Said lines advantageously have a width between 2 mm and 6 mm and they are advantageously spaced 4 mm to 10 mm apart. Said lines can be superposed onto other networks of lines intended to fulfill other functions, such as holding the stomach flat or shaping the buttocks.

In a preferred embodiment, the lines applied in zones A, B, C are executed in silicone rubber with a density between 10 and 40 g/cm$^3$. The silicone is silk-screened onto the front side 11 of the pant when flat (that is, before molding) and thermally polymerized (for instance, at 175° C. for 30 seconds under infrared light, other heating modes being possible, of course). This polymerization is achieved either as a stage independent of the molding, or it can be partially integrated into the subsequent stage of molding the pouch if the mold used also includes a planar heating surface for heating zone C. The thickness of the silicone laid down is about 0.20 to 0.25 mm (a thickness on the order of that of the base knit). The thickness can vary in places so as to render the material more or less rigid or elastic.

If thermoformed bands are used instead of silicone lines in order to form the elongated reinforcing elements, the general architecture remains the same, but the number of bands is naturally lower than the number of lines.

The invention claimed is:

1. A men's under-garment configured for a lower part of the body of a wearer, the undergarment comprising:

a rear side and a front side including an upper belt part and a lower crotch part, the front side including a central part disposed vertically in a middle of the front side and intended to accommodate the genitals of the wearer, the central part including a relatively wide lower part for the crotch part, a relatively narrow upper part for the belt part, and side edges;

elongated, elastic, reinforcing elements comprising elastic material and having an elongate structure, the elongated reinforcing elements being inserted into or attached substantially continuously to the front side and over the central part to reinforce support of the genitals;

wherein the elongated reinforcing elements are provided in a plurality of zones of the front side, the plurality of zones comprising:

a) a support zone located at a bottom of the central part, the elongated reinforcing elements having a roughly cradle-like shape in the support zone, b) a control zone located at a top of the central part, the elongated reinforcing elements having a roughly inverted-cradle-like shape in the control zone, and c) a reinforcement zone located on either lateral side of the central part, the elongated reinforcing elements having a slanting direction in the reinforcement zone, wherein the elongated reinforcing elements at the side edges of the central part are bound to the upper belt part of the front side so as to pull the support zone toward the top and the lateral sides of the undergarment.

2. The under-garment according to claim 1, wherein the central part forms a pouch configured to give the central part an outward curve.

3. The under-garment according to claim 2, wherein the elongated reinforcing elements form at least one network of parallel lines in each zone.

4. The under-garment according to claim 3, wherein the elongated reinforcing elements form two symmetrical networks which cross each other in the support zone and in the control zone.

5. The under-garment according to claim 1, wherein the elongated reinforcing elements form at least one network of parallel lines in each zone.

6. The under-garment according to claim 5, wherein the elongated reinforcing elements form two symmetrical networks which cross each other in the support zone and in the control zone.

7. The under-garment according to claim 5, wherein the elongated reinforcing elements form at least one network of parallel lines in each zone of the support zone, the control zone, and the reinforcement zone.

8. The under-garment according to claim 7, wherein the elongated reinforcing elements form two symmetrical networks which cross each other in the support zone and in the control zone.

9. The under-garment according to claim 5, wherein the elongated reinforcing elements are elements added on by embroidering, affixed to the front side by heat-sealed adhesive tape, affixed to the front side by heat-sealed adhesive material, or applied to the front side in the form of lines or cords of elastic polymer.

10. The under-garment according to claim 9, wherein the elongated reinforcing elements are lines of silicone rubber, applied flat onto the material of the front side, and particularly onto that of the central part, before molding the central part.

11. The under-garment according to claim 5, wherein the rear side and the front side comprise a jersey knit of at least one of polyamide-spandex, cotton-spandex, or polyester-spandex.

12. The under-garment according to claim 1, wherein part of the elongated reinforcing elements of the reinforcement zone extend into the support zone without changing direction.

13. The under-garment according to claim 1, wherein part of the elongated reinforcing elements of the reinforcement zone extend into the control zone, but changing direction.

14. The under-garment according to claim 1, wherein the elongated reinforcing elements are embroidered to the front side, affixed to the front side by heat-sealed adhesive tape, affixed to the front side by heat-sealed adhesive material, or applied to the front side in the form of lines or cords of elastic polymer.

15. The under-garment according to claim 14, wherein the elongated reinforcing elements are lines of silicone rubber, applied flat onto the material of the front side, and particularly onto that of the central part, before molding the central part.

16. The under-garment according to claim 1, wherein the rear side and the front side comprise a jersey knit of at least one of polyamide-spandex, cotton-spandex, or polyester-spandex.

17. The under-garment according to claim 1, wherein the elongated reinforcing elements in the reinforcement zone are heat-sealed to the front side of the under-garment.

18. The under-garment according to claim 1, wherein the rear side and the front side are formed from a circularly knit tube with a uniform elasticity.

19. The under-garment according to claim 1, wherein the reinforcing elements comprise elastic, thermoformed bands having an elasticity higher than or equal to that of a material of the front side.

20. The under-garment according to claim 1, wherein the reinforcing elements comprise a structured material with elasticity higher than or equal to that of a material of the front side.

* * * * *